United States Patent [19]

Bendler et al.

[11] Patent Number: 4,464,990

[45] Date of Patent: Aug. 14, 1984

[54] IGNITION DEVICE WITH AMPLIFIER CHARGE

[75] Inventors: Hellmut Bendler; Gerrit Scheiderer, both of Furth, Fed. Rep. of Germany

[73] Assignee: Dynamit Nobel AG, Troisdorf, Fed. Rep. of Germany

[21] Appl. No.: 296,788

[22] Filed: Aug. 27, 1981

[30] Foreign Application Priority Data

Aug. 30, 1980 [DE] Fed. Rep. of Germany ..... 3032712

[51] Int. Cl.[3] ..... F42B 3/00

[52] U.S. Cl. ..... 102/204; 102/470

[58] Field of Search ..... 102/200, 204, 470

[56] References Cited

U.S. PATENT DOCUMENTS 1,313,801 8/1919 Doran ..... 102/204

FOREIGN PATENT DOCUMENTS 2708525 8/1978 Fed. Rep. of Germany ..... 102/470
6414427 6/1965 Netherlands ..... 102/470
965413 7/1964 United Kingdom ..... 102/470

*Primary Examiner*—Charles T. Jordan
*Assistant Examiner*—Ted L. Parr
*Attorney, Agent, or Firm*—Antonelli, Terry & Wands

[57] ABSTRACT

An impact sensitive ignition device with an amplifier charge including a housing having a bottom and side wall, the side wall having a shoulder. An igniter is disposed in the housing at the bottom thereof with an anvil positioned in the housing for cooperation with the igniter. The anvil has at least one aperture therethrough and is supported on the shoulder of the housing. A sleeve member is disposed above the anvil and has an open end with a flange thereat, the sleeve member being coupled to the housing at the flange thereof, and the amplifier charge is disposed in the sleeve member.

17 Claims, 3 Drawing Figures

IGNITION DEVICE WITH AMPLIFIER CHARGE

Figure 1:
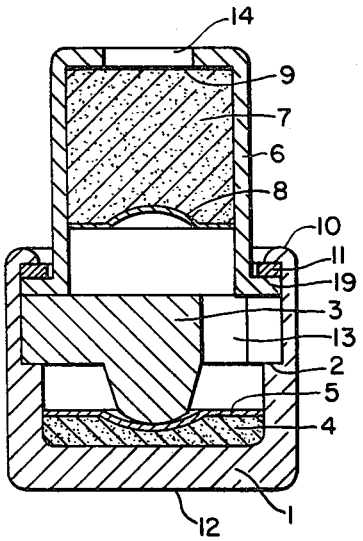

The present invention relates to a percussion or impact-sensitive ignition device with an amplifier charge wherein an igniter is located on a bottom of a step-shaped housing and an anvil which is functionally connected with the igniter is held in the housing by a flange-type shoulder.

German Pat. No. 1,171,321 teaches an ignition screw wherein an igniter-free amplifier charge is arranged in series with an ignition charge. Both charges are then placed in a relatively stable thick-walled housing, which housing is provided toward its forward, powder-charge end with a relatively thin cover.

German Offenlegungsschrift No. 2,708,525 also teaches an impact-sensitive ignition device with a step-shaped housing having an igniter, anvil, and an additional charge functionally linked to the igniter, contained in said housing, whereby the anvil is held at a specified distance from the inside of the bottom of the housing, which in this case is once again relatively stable and thickwalled.

In both cases, provision is made for inserting the ignition screw or the ignition device in the usual fashion in an external depression in the relatively thick bottom of a cartridge or the like, and holding the amplifier charge or the additional charge in a functinal connection with the powder charge by means of one or more ignition channels extending through the bottom of the cartridge.

It is an object of the present invention to provide an improved ignition device with series charge and/or amplifier charge and to improve the effect thereof.

According to the present invention, a percussion or impact sensitive ignition device with an amplifier charge includes a step-shaped housing having a bottom on which an igniter is located with an anvil being functionally connected with the igniter and being held in the housing by a flange-type shoulder and the amplifier charge is located in a step-shaped sleeve having a flange-shaped band at its open end for being held in the housing with the band at a position above the anvil, the anvil having at least one aperture therethrough. Hence, the basis of the present invention is a device wherein the series-mounted amplifier charge is not contained together with the ignition charge in a thick-walled common housing, but rather to dispose the amplifier charge in a relatively thin-walled housing of its own, preferably provided with weakened zones, this housing being so designed and arranged that it passes through the bottom of the cartridge and extends up to the powder charge, and preferably extends more or less into the powder chamber, so that the ignition effect of the amplifier charge on the powder charge is considerably improved.

In accordance with a feature of the present invention, provision is made for crimping the amplifier charge sleeve with interposition of a ring made of metal or the like in the housing. This arrangement has the advantage that if there are any inaccuracies in manufacture, they can be overcome simply by using a more or less thick metal ring or the manufacturing tolerance requirements can be made correspondingly less strict.

Depending on the volume of powder charge to be ignited, a larger or smaller amount of amplifier charge is provided. Thus, it may happen that if it is intended to extend the amplifier charge housing very far into the powder charge, the amplifier charge will fill only a portion of the amplifier charge sleeve. In order to keep the amplifier charge defined in the sleeve, it is advantageous to provide it with a cover according to another feature of the present invention. Such a cover, however, may also be advantageous from the manufacturing standpoint because it holds the charge in its proper location in the sleeve and thus makes it possible to effect a connection with the other parts of the ignition arrangement without having to fear that the amplifier charge will fall out of its sleeve.

Since the amplifier charge sleeve in accordance with the present invention is protected against mechanical or other stresses by the bottom of the cartridge or the like, the amplifier charge sleeve of the housing can be made with relatively thin walls. In order further to improve the effect of the amplifier charge upon the powder charge to be ignited, provision can be made for equipping the sleeve wall and/or the sleeve bottom with weakened zones, so that when ignition occurs, the sleeve wall will change shape in a precisely defined and predictable fashion. It is especially advantageous for relatively long powder charges with a relatively small diameter to make the weakened zone in the form of a central through opening in the bottom of the sleeve, so that the amplifier charge, when ignited, acts like a powerful axial jet in the powder charge. In order to prevent the amplifier charge from falling out of the opening, the latter is advantageously covered by a disc or the like when the amplifier charge is more or less loose in the sleeve.

Figure 2:
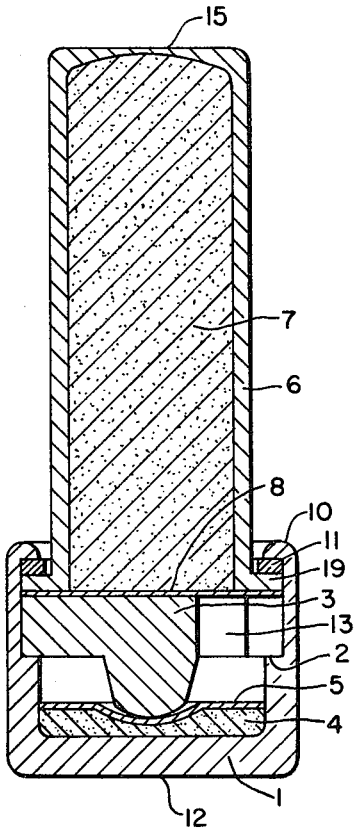
Figure 3:
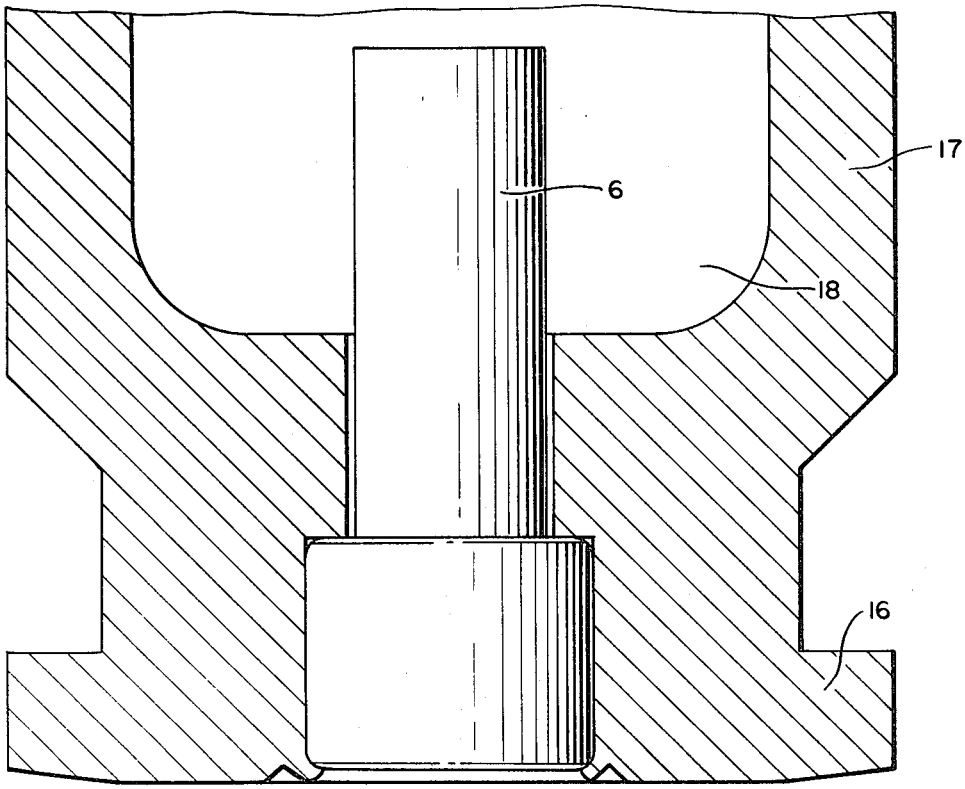

These and further objects, features and advantages of the present invention will become more obvious from the following description when taken in connection with the accompanying drawings which show, for purposes of illustration only, several embodiments in accordance with the present invention, wherein FIG. 1 shows in cross section an embodiment of an ignition device according to the present invention, in cross section;

FIG. 2 shows in cross section another embodiment in accordance with the present invention; and FIG. 3 illustrates the ignition device in a cartridge.

Referring now to the drawings wherein like reference numerals are utilized to designate like parts throughout the several views, there is shown in FIG. 1 an igniter 4 mounted on a relatively thick bottom 12 of a step-shaped housing 1 and covered by a cover 5, which can be made, for example, of paper or tin-plated lead foil. An additional protection provided by varnishing is also possible. The housing 1 is provided with a step-like shoulder 2, upon which an anvil 3 rests with its flange. An amplifier charge sleeve 6, with an amplifier charge 7, rests in turn upon the flange of the anvil by means of its annular bead-shaped flange 19. The amplifier charge sleeve 6 is held in the housing 1 through interposition of annular discs 11 made of metal or another suitable material by means of a bead 10 of the housing. The amplifier charge 7 which may also be a propellant powder charge is covered by a disc 8 made of paper or another suitable material. The amplifier charge sleeve 6 has an opening 14 in its bottom, the opening being closed by means of a covering disc 9 which is likewise made of paper or another suitable material. The anvil 3 is provided with an aperture 13 to permit the ignition stream of the ignition charge 4 to reach the amplifier charge 7, and, of course, several such apertures can also be provided through the cross section of the anvil.

The embodiment of the invention shown in FIG. 2 essentially corresponds to the embodiment of FIG. 1, but is provided with a much larger amplifier charge 7 and the amplifier charge sleeve 6 is not open at the bottom, but rather is provided with a weakened zone 15. Between the anvil 3 and the amplifier charge sleeve 6, the cover 8 made of paper or the like is provided, whereby it is also possible to add the amplifier charge 7 in loose form in the sleeve 6.

It will be understood that depending on the nature of the application and needs, the amplifier charge sleeve 6 can be appropriately designed and dimensioned with the amplifier charge 7, and that charge 7 can also be selected qualitatively in line with requirements. Thus, it is possible, for example, as in German Pat. No. 1,171,321, to use an igniter-free charge or even a thermal charge, e.g., boron potassium nitrate. It is also possible to use as the charge 7, a known propellant charge powder, such as black powder or monobasic or dibasic propellant charge powder.

In the embodiment shown in FIG. 3, the complete ignition element is illustrated as inserted in a bottom 16 of the rear end of a cartridge 17, whereby the amplifier charge sleeve 6 passes through the bottom of the cartridge far into the chamber 18 for the powder propellant charge of the cartridge, thereby ensuring reliable and satisfactory ignition of the powder charge. The ignition device is prevented from falling out in the usual and known fashion, for example, by caulking the bottom of the cartridge.

While we have shown and described several embodiments in accordance with the present invention, it is understood that the same is not limited thereto but is susceptible of numerous changes and modifications as known to a person skilled in the art, and we therefore do not wish to be limited to the details shown and described herein but intended to cover all such changes and modifications as are obvious to one of ordinary skill in the art.

We claim:

1. An impact sensitive ignition device comprising a housing having a closed bottom member and a side wall secured thereto, the side wall having a shoulder along the inner periphery thereof, an igniter disposed within the housing along the closed bottom member, an anvil positioned in the housing for cooperation with the igniter, the anvil having at least one aperture therethrough and being supported on the shoulder of the side wall of the housing, a sleeve member disposed above the anvil and having an open end proximate to the anvil, the open end of the sleeve member having a flange thereat, the sleeve member being coupled to the housing at the flange thereof, and an amplifier charge disposed in the sleeve member.

2. An impact sensitive ignition device according to claim 1, wherein the flange of the sleeve member is an outwardly extending flange, and further comprising a ring-like member supported on the flange of the sleeve member, the side wall of the housing having an end arranged for being crimped so as to maintain the sleeve member within the housing through the interposition of the ring-like member.

3. An impact sensitive ignition device according to claim 2, wherein the ring-like member is formed of metal.

4. An impact sensitive ignition device according to claim 1, further comprising covering means for covering the amplifier charge within the sleeve member.

5. An impact sensitive ignition device according to claim 1, wherein the sleeve member includes a bottom member and a cylindrical side wall, at least one weakened zone being provided in at least one of the bottom member and cylindrical side wall of the sleeve member.

6. An impact sensitive ignition device according to claim 5, wherein the at least one weakened zone is provided at a central part of the sleeve member.

7. An impact sensitive ignition device according to claim 6, wherein the at least one weakened zone includes a central through opening provided in the bottom member of the sleeve member.

8. An impact sensitive ignition device according to claim 7, further comprising means for covering the opening in the bottom member of the sleeve member.

9. An impact sensitive ignition device according to claim 1, wherein the closed bottom member and at least a portion of the side wall of the housing have thickness greater than the thickness of the sleeve member.

10. An impact sensitive ignition device according to claim 1, wherein the housing has an open end, the sleeve member extending outwardly through the open end of the housing, the flange of the sleeve member being an outwardly extending flange with the sleeve member being supported by the anvil within the housing.

11. An impact sensitive ignition device according to claim 10, wherein the sleeve member includes a bottom and cylindrical side wall, at least one weakened zone being provided in at least one of the bottom and cylindrical side wall of the sleeve member.

12. An impact sensitive ignition device according to claim 11, wherein the at least weakened zone is provided in the bottom of the sleeve member.

13. An impact sensitive ignition device according to claim 12, further comprising covering means for covering the amplifier charge within the sleeve member.

14. An impact sensitive ignition device according to claim 13, wherein the at least one weakened zone is a central through opening provided in the bottom of the sleeve member.

15. An impact sensitive ignition device according to claim 14, further comprising another covering means for covering the opening in the bottom of the sleeve member.

16. An impact sensitive ignition device according to claim 10, wherein the bottom and at least a portion of the side wall of the housing have a thickness greater than the thickness of the sleeve member.

17. An impact sensitive ignition device according to claim 16, further comprising a ring-like member supported on the flange of the sleeve member, the side wall of the housing having an end arranged for being crimped so as to maintain the sleeve member within the housing through the interposition of the ring-like member.

* * * * *